US009815070B2

(12) United States Patent
Lin et al.

(10) Patent No.: US 9,815,070 B2
(45) Date of Patent: Nov. 14, 2017

(54) OUTLET DEVICE AND A SHOWER HEAD HAVING THE OUTLET DEVICE

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Renbang Lin, Xiamen (CN); Wenxing Chen, Xiamen (CN); Mingfu Zhang, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 14/998,265

(22) Filed: Dec. 26, 2015

(65) Prior Publication Data

US 2016/0184841 A1 Jun. 30, 2016

(30) Foreign Application Priority Data

Dec. 26, 2014 (CN) ..... 2014 1 0826220

(51) Int. Cl.

| | |
|---|---|
| ***B05B 1/26*** | (2006.01) |
| ***B05B 1/18*** | (2006.01) |
| ***B05B 1/16*** | (2006.01) |
| ***B05B 3/00*** | (2006.01) |
| ***B05B 3/04*** | (2006.01) |

(52) U.S. Cl.

CPC ..... *B05B 1/267* (2013.01); *B05B 1/1636* (2013.01); *B05B 1/185* (2013.01); *B05B 3/008* (2013.01); *B05B 3/04* (2013.01); *B05B 3/0422* (2013.01)

(58) Field of Classification Search

CPC ..... B05B 1/185; B05B 1/267; B05B 3/008; B05B 3/0422; B05B 1/1636; B05B 3/04

USPC ..... 239/240, 391

See application file for complete search history.

(56) References Cited

U.S. PATENT DOCUMENTS

| | | | | |
|---|---|---|---|---|
| 5,385,532 A * | 1/1995 | Shyu | A46B 13/06 | 15/29 |
| 6,896,201 B1 * | 5/2005 | Ouyoung | B05B 1/14 | 239/240 |
| 7,946,512 B2 * | 5/2011 | Schorn | B05B 1/185 | 239/225.1 |

(Continued)

FOREIGN PATENT DOCUMENTS

CN 100553789 C 10/2009

*Primary Examiner* — Arthur O Hall
*Assistant Examiner* — Steven M Cernoch
(74) *Attorney, Agent, or Firm* — Rabin & Berdo, P.C.

(57) ABSTRACT

An outlet device that may be used in a shower head includes a base portion that is disposed with at least one inlet and a plurality of diversion holes. The base portion is disposed with a impeller. The impeller rotates when it is impacted by water flowing. A guard sheet is movably disposed in the base portion. The impeller is connected to the guard sheet in driving way so that the impeller rotates to drive the guard sheet to move. The guard sheet moves with respect to the base portion to control the diversion holes to outflow water in cycles intermittently. Each diversion hole is rotatably connected with an outlet nozzle. The impeller rotates to drive the outlet nozzles to rotate to outflow rotating water. The impeller and the outlet nozzles cooperate to achieve a rotating water with strong massage effect.

15 Claims, 10 Drawing Sheets

(56) References Cited

U.S. PATENT DOCUMENTS

| | | | | |
|---|---|---|---|---|
| 8,403,240 | B2 * | 3/2013 | Chen | B05B 1/14 239/240 |
| 2002/0100818 | A1 * | 8/2002 | Blessing | B05B 1/1636 239/394 |
| 2008/0083077 | A1 * | 4/2008 | Alexander | A46B 5/0095 15/53.1 |
| 2014/0008462 | A1 * | 1/2014 | Gransow | B05B 1/18 239/391 |
| 2014/0110502 | A1 * | 4/2014 | Yu | B05B 1/18 239/240 |

* cited by examiner

B-B

OUTLET DEVICE AND A SHOWER HEAD HAVING THE OUTLET DEVICE

FIELD OF THE INVENTION

The present invention relates to an outlet device and a shower head having the outlet device.

BACKGROUND OF THE INVENTION

A shower head used in sanitary ware product is published in Chinese patent database in Oct. 28, 2009 with authorized announcement number CN100553789C. The shower head comprises a base portion having an inlet and a plurality of diversion holes, the base portion is disposed with a impeller in rotating way, the impeller rotates by the impacting of the water flowing from the inlet; each diversion hole is rotatably connected with an outlet nozzle, the outlet nozzle has an outlet, the outlet direction of the outlet is intersected with the rotating axis of the outlet nozzle, the impeller is connected to the outlet nozzle in driving way, so that the impeller rotates to drive the outlet nozzle to rotate, so that the outlet outflows rotating water. However, there is one problem that the outlet function of the shower head is single and dull.

SUMMARY OF THE INVENTION

The present invention is provided with an outlet device and a shower head having the outlet device, which overcome the disadvantage of the shower head used in sanitary ware product of the existing technology.

A technical proposal of the present invention is that:

An outlet device, comprising a base portion (100), the base portion (100) is disposed with at least an inlet (100) and a plurality of diversion holes (120), the base portion (100) is disposed with a impeller (130), the impeller (130) rotates when impacted by water flowing; wherein a guard sheet (140) is movably disposed in the base portion (100), the impeller (130) is connected to the guard sheet (140) in driving way, so that the impeller (130) rotates to drive the guard sheet (140) to move, the guard sheet (140) moves with respect to the base portion (100) to control the diversion holes (120) to outflow water in cycles intermittently; each diversion hole (120) is rotatably connected with an outlet nozzle (150), the impeller (130) is connected to the outlet nozzles (150) in driving way, so that the impeller (130) rotates to drive the outlet nozzles to rotate.

In another preferred embodiment, the guard sheet (140) is fixedly connected to the impeller (130).

In another preferred embodiment, the impeller (130) is connected with a driving gear (132) coaxially, each outlet nozzle (150) is fixedly connected with a driven gear (152) coaxially, the driven gears (152) are engaged to the driving gear (132).

In another preferred embodiment, the diversion holes (120) are annularly arranged about the rotating axis of the impeller (130); the outlet nozzles (150) are annularly arranged about the rotating axis of the impeller (130).

In another preferred embodiment, the rotating axis of the outlet nozzle (150) is parallel to the rotating axis of the impeller (130).

In another preferred embodiment, the outlet nozzle (150) has outlet (151), the outflow direction of the outlet (151) is intersected with the rotating axis of the outlet nozzle (150).

In another preferred embodiment, the base portion (100) comprises a base (160), a cover (170) and a capping (180); the base (160) is disposed with a plurality of assembly holes (161), the cover (170) covers on the base (160) in sealing way, the cover (170) is disposed with a plurality of diversion openings, the diversion openings are respectively connected to the assembly holes (161) to form above mentioned diversion holes (120), the outlet nozzles (150) are assembled in the assembly holes (161); the capping (180) covers on the cover (170) in sealing way and forming an upper chamber, the impeller (130) is disposed in the upper chamber, the guard sheet (140) is movably contacted on the cover 91700, the impeller (130) has a power shaft, the power shaft runs through the cover (170) from top to bottom to connect to the outlet nozzle (150) in driving way.

In another preferred embodiment, the periphery of the diversion opening of the cover (170) extends downwardly to form a conduit (171), the end face of the outlet nozzle (150) is concaved with a groove connected to the outlet (151), the conduit (171) is rotatably connected to the groove in fitting way.

In another preferred embodiment, the end portion of the outlet nozzle (150) extends outwardly to form an annular portion, the annular portion is connected to the power shaft of the impeller (130) in driving way, the annular portion is supported on the base (160).

In another preferred embodiment, a retarding mechanism (400) is disposed between the impeller (130) and the driving gear (132), the retarding mechanism (400) comprises a change gear set (420), an internal gear (430) and a pinion gear (410).

In another preferred embodiment, the lower end of the impeller (130) is connected to the pinion gear (410), the large gear (421) of the change gear set (420) is engaged to the pinion gear (410), the small gear (422) of the change gear set (420) is engaged to the internal gear (430); the upper end of the driving gear (132) is connected to the internal gear (430) in driving way.

In another preferred embodiment, the guard sheet (140) is fixedly connected to the outer side of the internal gear (430).

In another preferred embodiment, the base portion (100) comprises a base (160), an upper cover (170A), a lower cover (170B) and a capping (180); the base (160) is disposed with a plurality of assembly holes (161), the lower cover (170B) covers on the base (160) in sealing way, the lower cover (170B) is disposed with a plurality of diversion openings, the diversion openings are respectively connected to the assembly holes (161) to form above mentioned diversion holes (120), the outlet nozzles (150) are assembled in the assembly holes (161); the capping (180) covers on the upper cover (170A) in sealing way and forming an upper chamber, the impeller (130) is disposed in the upper chamber; the upper cover (170A) and the lower cover (170B) are connected in sealing way and forming a central chamber, the retarding mechanism (400) is located in the central chamber; the guard sheet (140) is contacted on the lower cover (170B); the impeller (130) is connected to the guard sheet (140) by the retarding mechanism (400) in driving way and is at the same time connected to the outlet nozzles (150) in driving way.

Another technical proposal of the present invention is that:

A shower head having the outlet device, the shower head comprises a main body (200) and a switch mechanism (300), the main body (200) is disposed with an inlet waterway (210) and at least two diversion waterways, the switch mechanism (300) is assembled to the main body (200) and is connected to the inlet waterway (210) and the at least two diversion waterways to control the at least two diversion waterways to connect to the inlet waterway (210) alternately; the base portion (100) of the outlet device is assembled in the main body (200) and one diversion waterway is connected to the inlet (110).

Compared to the existing technology, the present invention has advantages as follows:

Water flows to the base portion from the inlet and compacts the impeller to drive the impeller to rotate, the impeller rotates and drives the guard sheet and the outlet nozzles to rotate, the guard sheet moves with respect to the base portion to control the diversion holes to outflow water in cycles intermittently, the impeller rotates to drive the outlet nozzles to rotate to outflow rotating water, the impeller and the outlet nozzles cooperate to achieve a rotating water with strong massage effect, it not only overcomes the disadvantage of the existing known technology, but also has following effect: firstly, the water rotates and it has massage function, the water effect is well; secondly, the impeller drives the guard sheet and the outlet nozzles to rotate, it cooperates with the movement of the guard sheet and the outlet nozzles, the structure is compact.

The guard sheet is fixedly connected to the impeller, the structure is compact and simple.

The impeller is fixedly disposed with a driving gear coaxially, each outlet nozzle is fixedly disposed with a driven gear coaxially, the driven gears are engaged to the driving gear, the structure is compact and simple, the guard sheet and the outlet nozzles rotate quickly, making it with strong massage performance even in a lower water pressure.

The rotating axis of the outlet nozzles is parallel to the rotating axis of the impeller, the structure is simple.

The base portion comprises a base, a cover and a capping, the outlet device can be modularized, the structure is compact that it is convenient to fit to other outlet mechanisms.

With the abutting and fitting of the conduit and the groove and the contacting and fitting of the annular portion and the base, the outlet nozzles are located and limited in the axial direction, the assembly is simple and quick, the structure is simple.

With the retarding mechanism, the movement speed of the massage outlet nozzles is reduced, so that it can better appear the rotating water type, making it with massage effect and visual effect.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
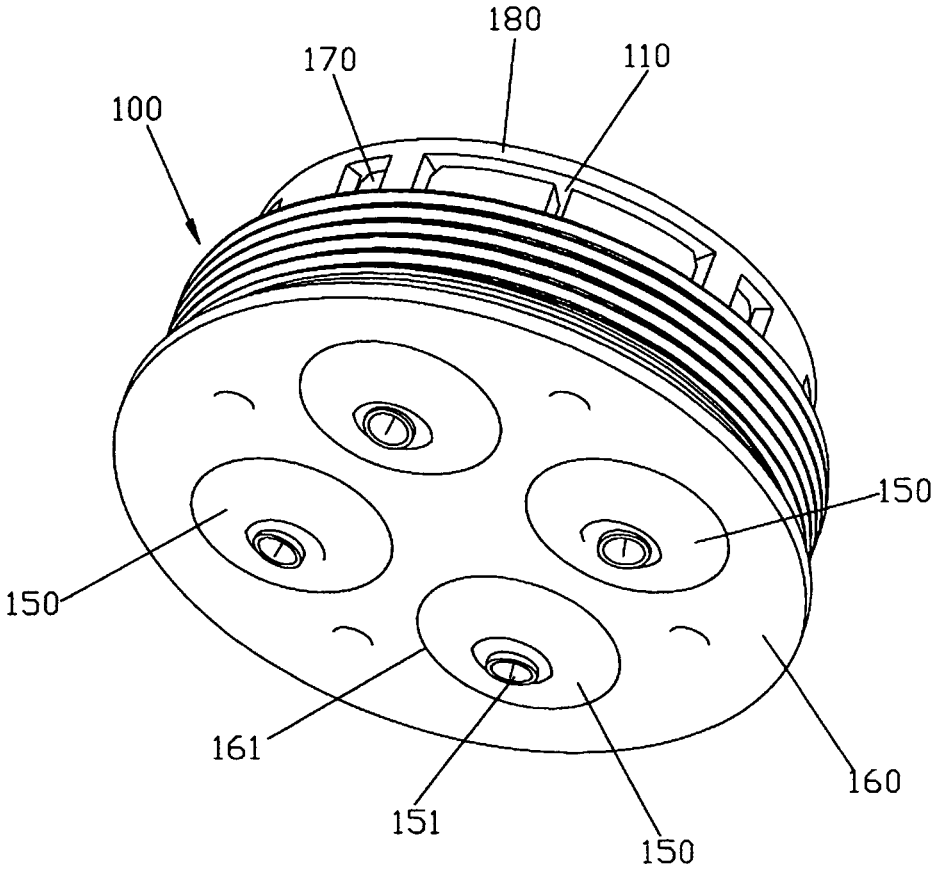
FIG. 1 illustrates a schematic diagram of the outlet device of a first embodiment.
Figure 2:
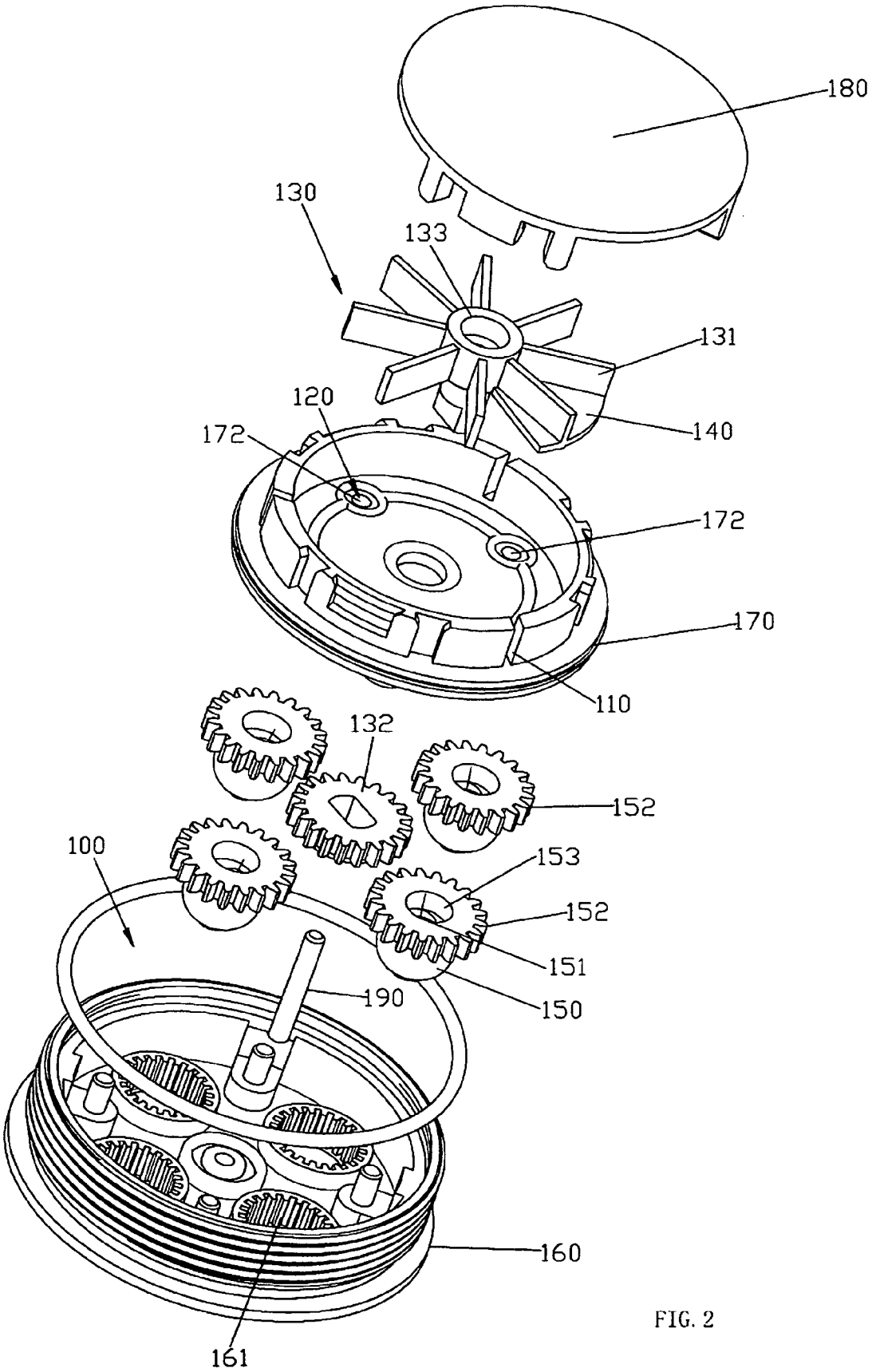
FIG. 2 illustrates an exploded and schematic diagram of the outlet device of the first embodiment.
Figure 3:
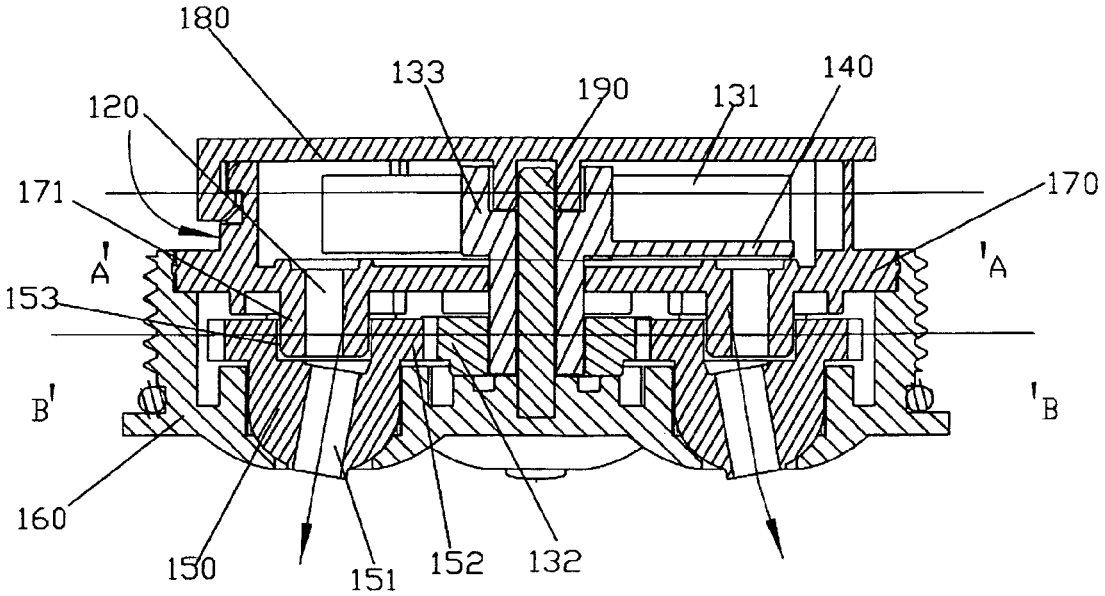
FIG. 3 illustrates a central sectional diagram of the outlet device of the first embodiment.
Figure 4:
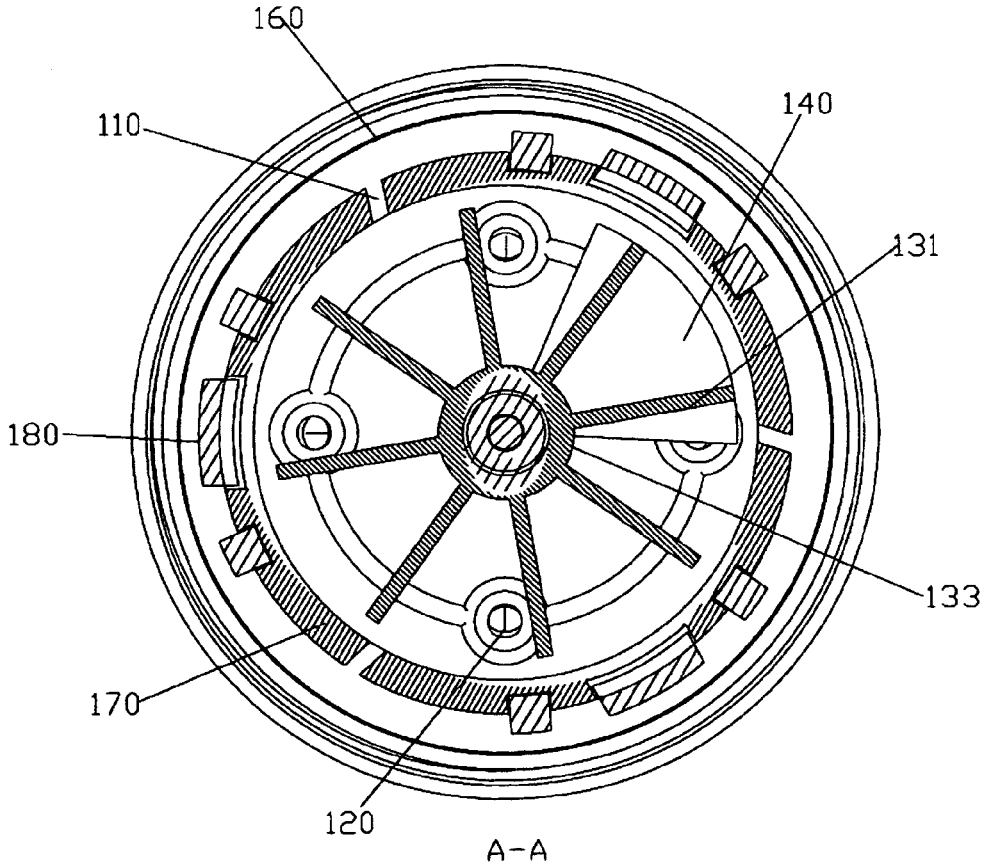
FIG. 4 illustrates a sectional diagram of FIG. 3 in A-A of the first embodiment.
Figure 5:
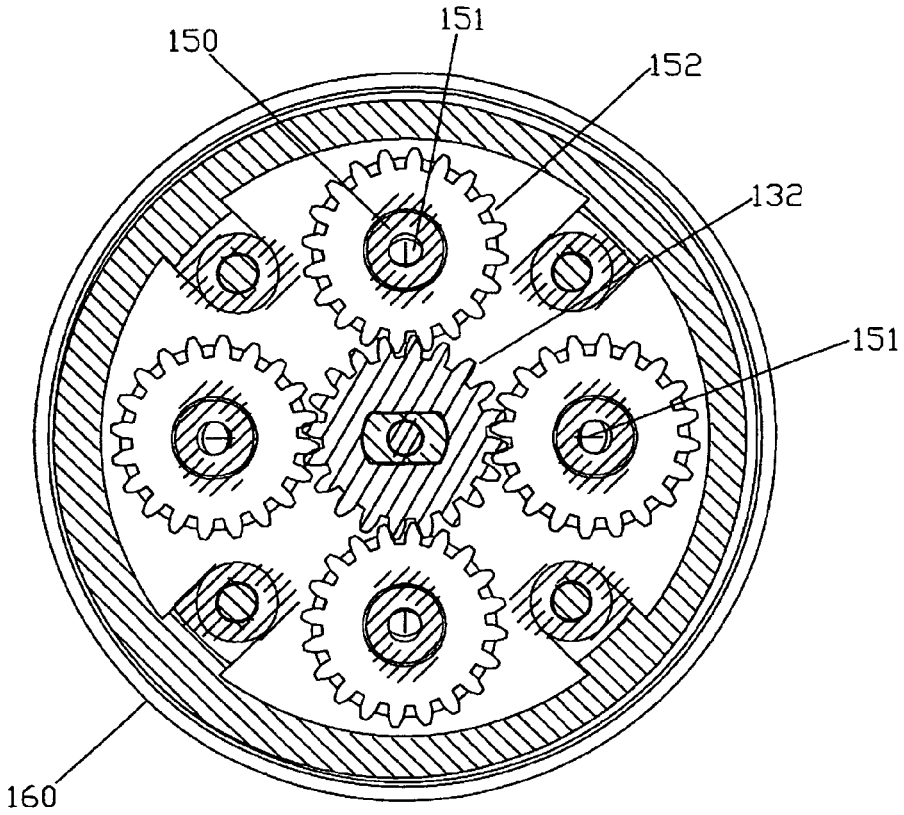
FIG. 5 illustrates a sectional diagram of FIG. 3 in B-B of the first embodiment.

Referring to FIGS. 1~5, an outlet device comprises a base portion 100, the base portion 100 is disposed with at least an inlet 110 and a plurality of diversion holes 120, the base portion 100 is disposed with a impeller 130, the impeller 130 rotates when impacted by water flowing; a guard sheet 140 is movably disposed in the base portion 100, the impeller 130 is connected to the guard sheet 140 in driving way, so that the impeller 130 rotates to drive the guard sheet 140 to move, the guard sheet 140 moves with respect to the base portion 100 to control the diversion holes 120 to outflow water in cycles intermittently; each diversion hole 120 is rotatably connected with an outlet nozzle 150, the outlet nozzle 150 is disposed with outlet 151, the outlet direction of the outlet 151 is intersected with the rotating axis of the outlet nozzle 150, the impeller 130 is connected to the outlet nozzles 150 in driving way, so that the impeller 130 rotates to drive the outlet nozzles 150 to rotate. In this embodiment, the outlet direction of the outlet 151 is the flowing direction of the end section of the outlet, at least it is the normal of the end of the outlet.

The impeller 130 comprises a central base 133 and a plurality of blades 131 annularly fixedly arranged at the outer side of the central base 133. The guard sheet 140 is fan shaped and is fixedly connected to the bottom end of at least one blade 131 of the impeller 130, the guard sheet can baffle at least one diversion hole. In this embodiment, the guard sheet is fixedly connected to the bottom end face of two blades.

In a preferred embodiment, the diversion holes 120 are annularly arranged about the rotating axis of the impeller 130; the outlet nozzles 150 are annularly arranged about the rotating axis of the impeller 130; the rotating axis of the outlet nozzle 150 is parallel to the rotating axis of the impeller 130. The impeller 130 is connected with a driving gear 132 coaxially, each outlet nozzle 150 is fixedly connected with a driven gear 152 coaxially, the driven gears 152 are annularly arranged at the outer side of the driving gear 132, the driven gears 152 are engaged to the driving gear 132, so that the impeller rotates to drive the outlet nozzles to rotate.

In a detailed structure, the base portion 100 comprises a base 160, a cover 170 and a capping 180; the base 160 is disposed with a plurality of assembly holes 161, the cover 170 covers on the base 160 in sealing way, the cover 170 is disposed with a plurality of diversion openings 172, the diversion openings are respectively connected to the assembly holes 161 to form above mentioned diversion holes 120, the outlet nozzles 150 are assembled in the assembly holes 161; the capping 180 covers on the cover 170 in sealing way and forming an upper chamber, the impeller 130 is disposed in the upper chamber, the guard sheet 140 is movably contacted on the cover 170, the impeller 130 has a power shaft, the power shaft runs through the cover 170 from top to bottom to connect to the outlet nozzle 150 in driving way.

The external periphery of the base 160 extends upwardly to form a first periphery wall, the cover 170 is fixedly connected in the periphery wall in sealing way on the base 160; the periphery of the diversion opening of the cover 170 extends downwardly to form a conduit 171, the end face of the outlet nozzle 150 is concaved with a groove 153 connected to the outlet 151, the conduit 171 is rotatably connected to the groove in fitting way so that water of the diversion opening flows to the outlet 151 through the conduit 171 and the groove; the end portion of the outlet nozzle 150 extends outwardly to form an annular portion, the annular portion is connected to the power shaft of the impeller 130 in driving way, the annular portion is supported on the base 160. With the abutting and fitting of the conduit 171 and the groove and the contacting and fitting of the annular portion and the base 160, the outlet nozzles 150 are located and limited in the axial direction. The driving gear 132 is located between the base and the cover, gear teeth are disposed at the outer side of the annular portion to form the driven gears.

The periphery of the cover 170 extends upwardly to form a second periphery wall, the capping 180 covers the second periphery wall of the cover 170 in sealing way; the upper end of the central base is rotatably connected to the capping 180, the lower end of the central base is rotatably connected to the cover 170. Preferred, a fixing shaft 190 is provided to run through the central base and fixedly connect to the capping 180 and the base 160.

Preferred, the inlet 110 is disposed at the second periphery wall, so that the water flowing can impact the blades.

The Second Embodiment

Figure 6:
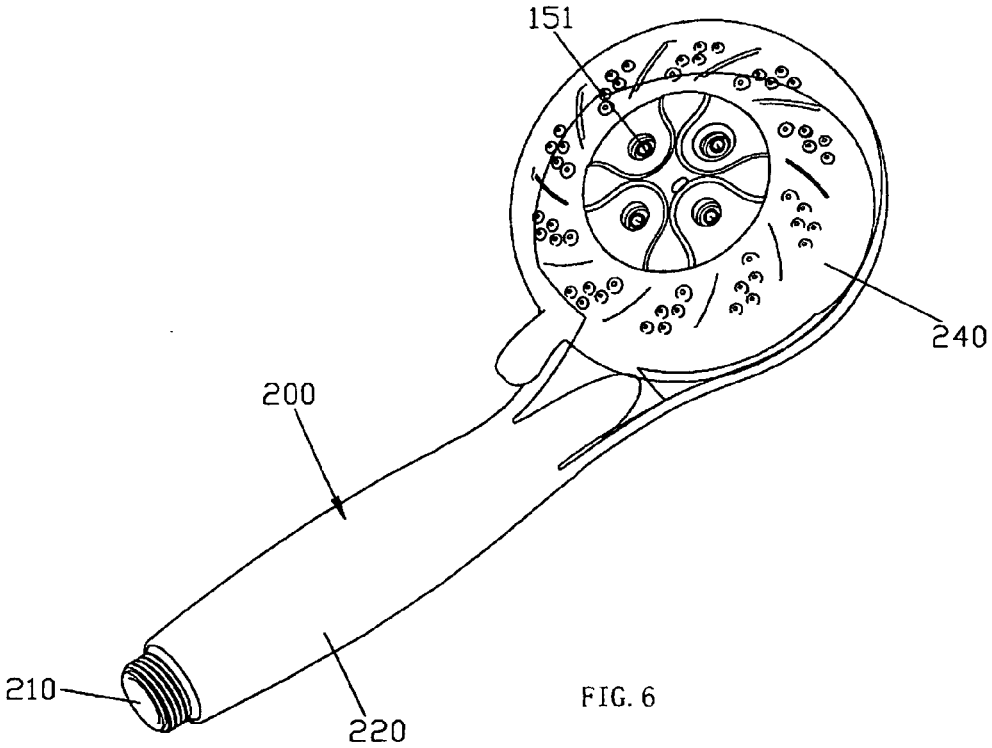
FIG. 6 illustrates a schematic diagram of a hand shower head of a second embodiment.
Figure 7:
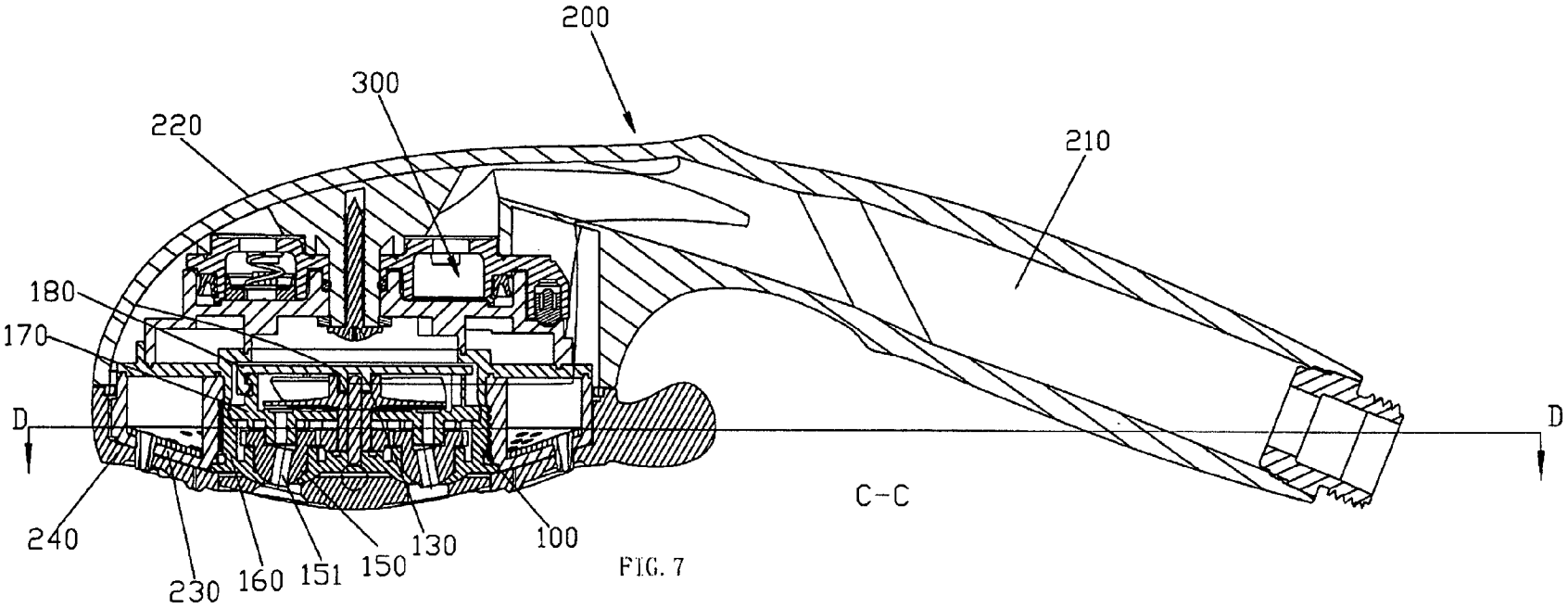
FIG. 7 illustrates a sectional diagram of FIG. 8 in C-C.
Figure 8:
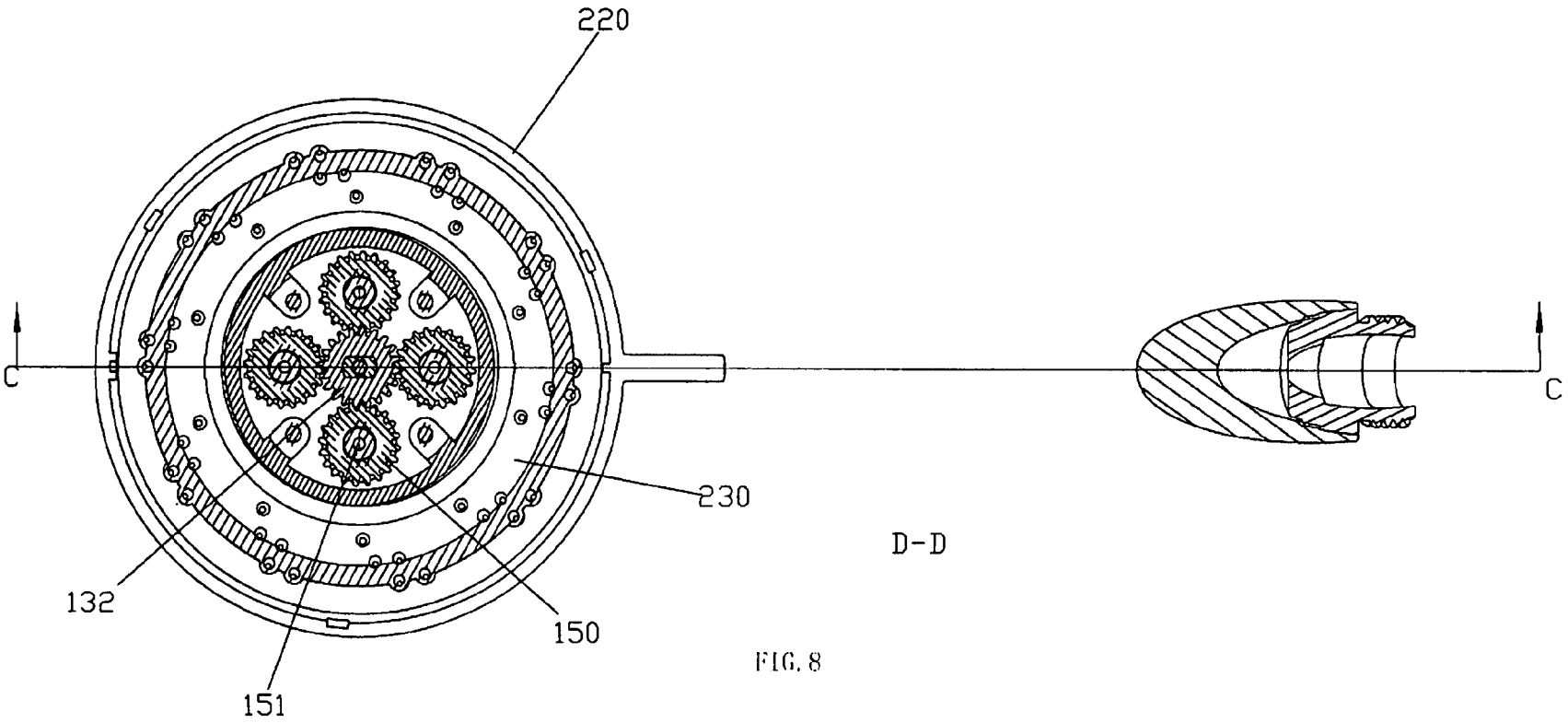
FIG. 8 illustrates a sectional diagram of FIG. 7 in D-D.
Figure 9:
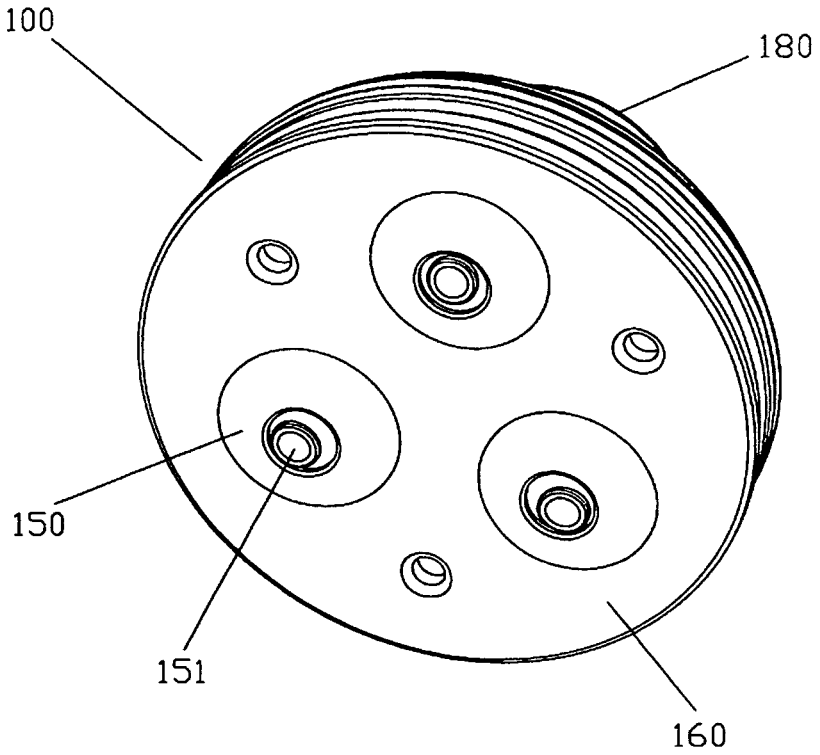
FIG. 9 illustrates a schematic diagram of the outlet device of a third embodiment.
Figure 10:
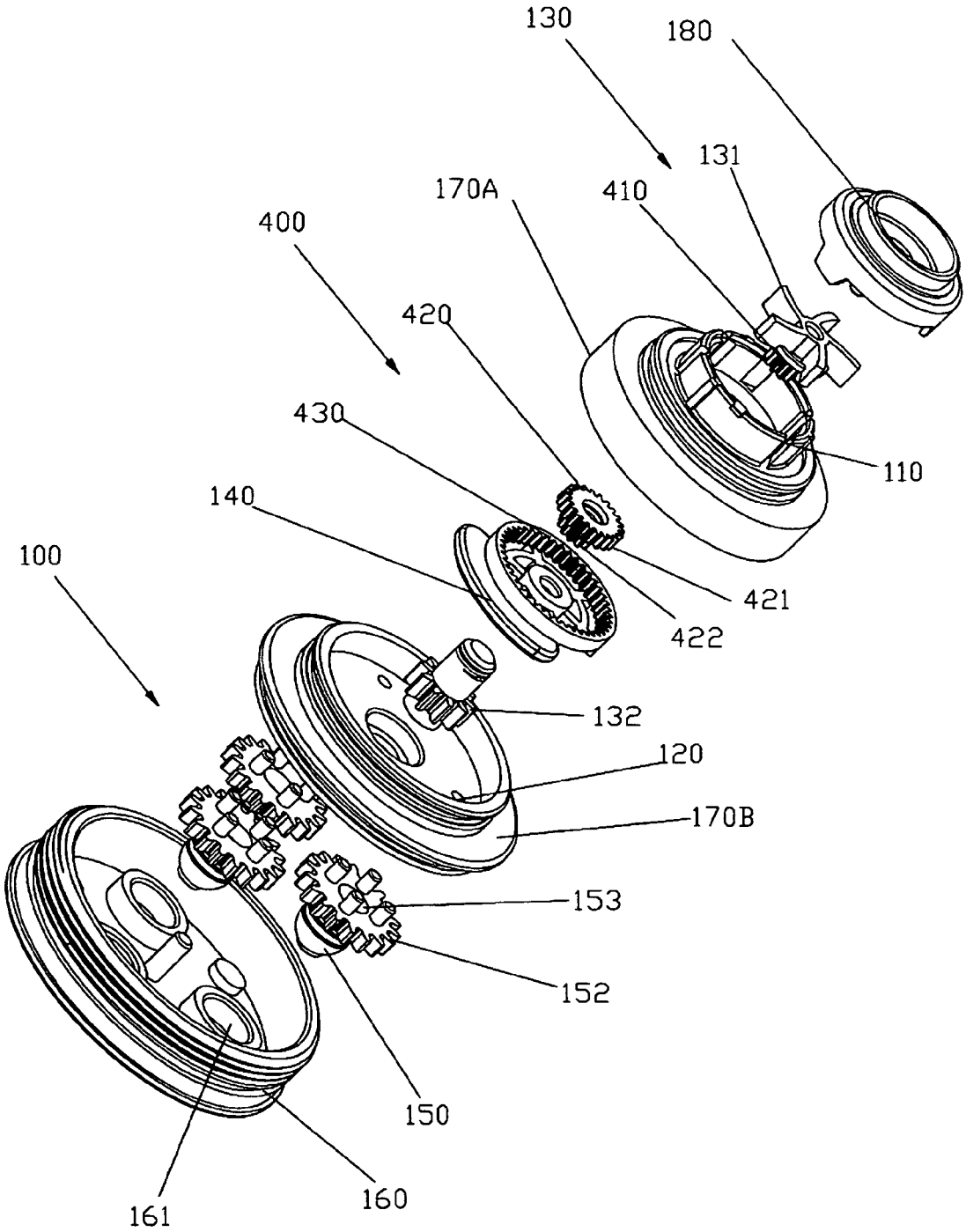
FIG. 10 illustrates an exploded and schematic diagram of the outlet device of the third embodiment.
Figure 11:
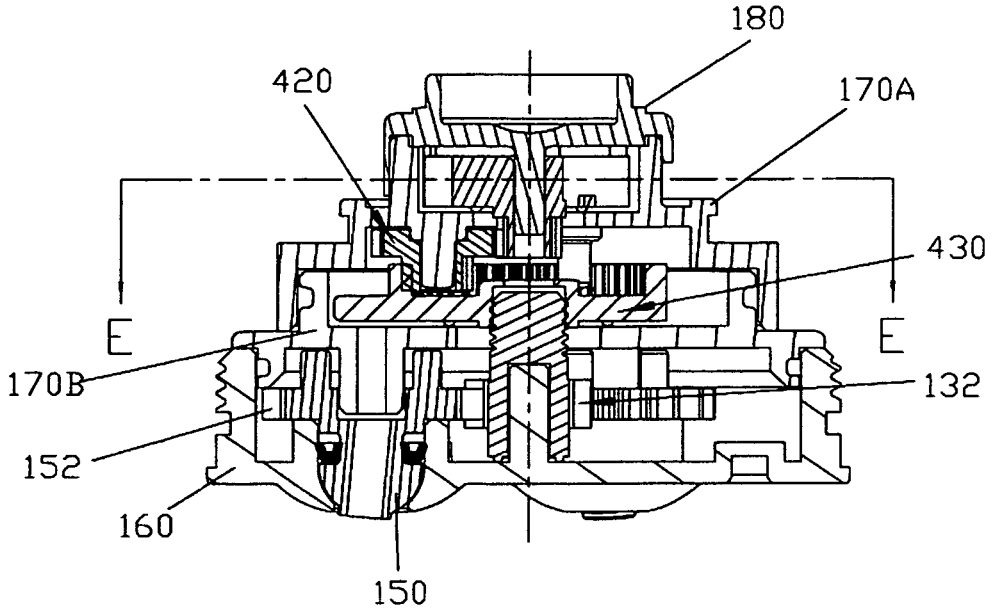
FIG. 11 illustrates a central sectional diagram of the outlet device of the third embodiment.
Figure 12:
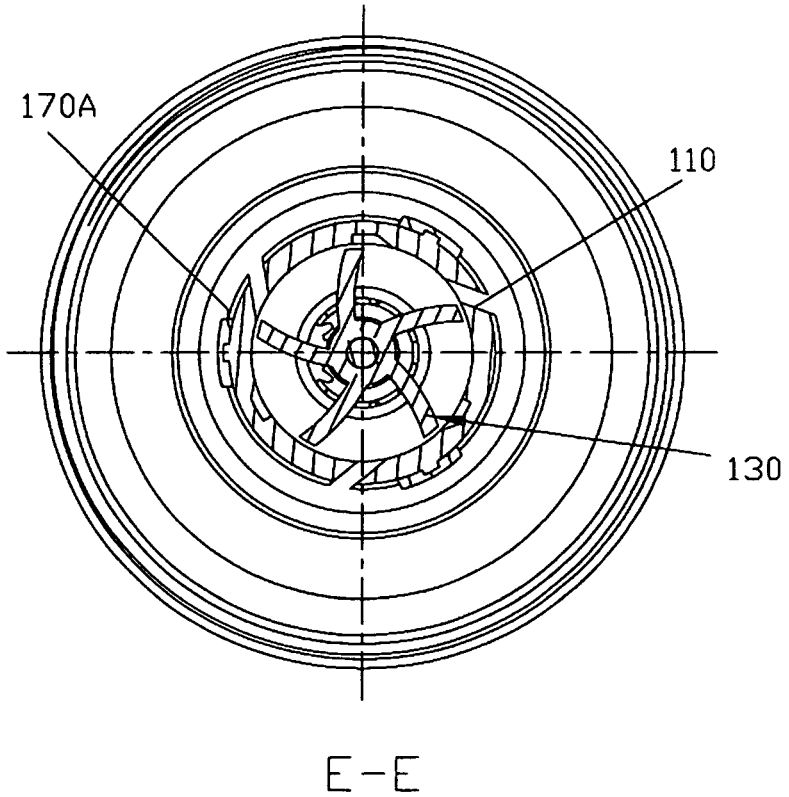
FIG. 12 illustrates a sectional diagram of FIG. 11 in E-E of the third embodiment.

Please referring to FIG. 6, FIG. 7 and FIG. 8, a shower head having above mentioned outlet device is provided, it comprises a main body 200 and a switch mechanism 300, the main body 200 is disposed with an inlet waterway 210 and at least two diversion waterways, the switch mechanism 300 is assembled to the main body 200 and is connected to the inlet waterway 210 and the at least two diversion waterways to control the at least two diversion waterways to connect to the inlet waterway 210 alternately; the base portion 100 of the outlet device is assembled in the main body 200 and one diversion waterway is connected to the inlet 110. In a detailed structure, the main body 200 comprises a body 220, a cover plate 230 fixedly connected to the body 220 and a decoration cover 240 rotatably connected to the cover plate 230, the center of the cover plate 230 is disposed with a first through hole, the center of the decoration cover 240 is disposed with a second through hole, the first through hole is corresponding to the second through hole. The base portion 100 of the outlet device is fixedly assembled to the body 220 and corresponding to the first through hole and the second through hole of the cover plate 230 and the decoration cover 240; the cover plate 230 is coupled to another diversion waterway to outflow another kind of water type. The decoration cover 240 is connected to the switch mechanism 300 in driving way, so that the decoration cover 240 rotates to switch the waterways.

The Third Embodiment

Referring to FIGS. 9~12, the outlet device of this embodiment differs from the first embodiment in that: a retarding mechanism 400 is disposed between the impeller 130 and the driving gear 132, the retarding mechanism 400 comprises a change gear set 420, an internal gear 430 and a pinion gear 410.

The lower end of the impeller 130 is connected to the pinion gear 410, the large gear 421 of the change gear set 420 is engaged to the pinion gear 410, the small gear 422 of the change gear set 420 is engaged to the internal gear 430; the upper end of the driving gear 132 is connected to the internal gear 430 in driving way.

The guard sheet 140 is fixedly connected to the outer side of the internal gear 430.

The base portion 100 comprises a base 160, an upper cover 170A, a lower cover 170B and a capping 180; the base 160 is disposed with a plurality of assembly holes 161, the lower cover 170B covers on the base 160 in sealing way, the lower cover 170B is disposed with a plurality of diversion openings, the diversion openings are respectively connected to the assembly holes 161 to form above mentioned diversion holes 120, the outlet nozzles 150 are assembled in the assembly holes 161; the capping 180 covers on the upper cover 170A in sealing way and forming an upper chamber, the impeller 130 is disposed in the upper chamber; the upper cover 170A and the lower cover 170B are connected in sealing way and forming a central chamber, the retarding mechanism 400 is located in the central chamber; the guard sheet 140 is contacted on the lower cover 170B; the impeller 130 is connected to the guard sheet 140 by the retarding mechanism 400 in driving way and is at the same time connected to the outlet nozzles 150 in driving way.

When used, the impeller 130 located in the upper cover 170A is impacted to rotate by the water flowing from the inlet 110; the base portion 100 is movably connected with the guard sheet 140, the impeller 130 is connected to the guard sheet 140 by the retarding mechanism 400 in driving way to drive the guard sheet 140 to move, the guard sheet 140 moves with respect to the base portion 100 to control the diversion holes 120 to outflow water in cycles intermittently; each diversion hole 120 is rotatably connected with the outlet nozzle 150, the outlet nozzle 150 is disposed with outlet 151, the outlet direction of the outlet 151 is intersected with the rotating axis of the outlet nozzle 150; and the impeller 130 is connected to the outlet nozzle 150 by the retarding mechanism 400 in driving way to drive the outlet nozzles 150 to rotate. In this embodiment, the outlet direction of the outlet 151 is the flowing direction of the end section of the outlet, at least it is the normal of the end of the outlet.

The capping 180 of the outlet device of this embodiment is a connecting base.

As with the retarding mechanism 400, the pinion gear 410 of the impeller 130 is engaged to the large gear 421 of the change gear set 420, and the small gear 422 is engaged to the internal gear 430, it forms a triple-reduction gear, so that the movement speed of the massage outlet nozzles is reduced, so that it can better appear the rotating water type, making it with massage effect and visual effect.

The Fourth Embodiment

Figure 13:
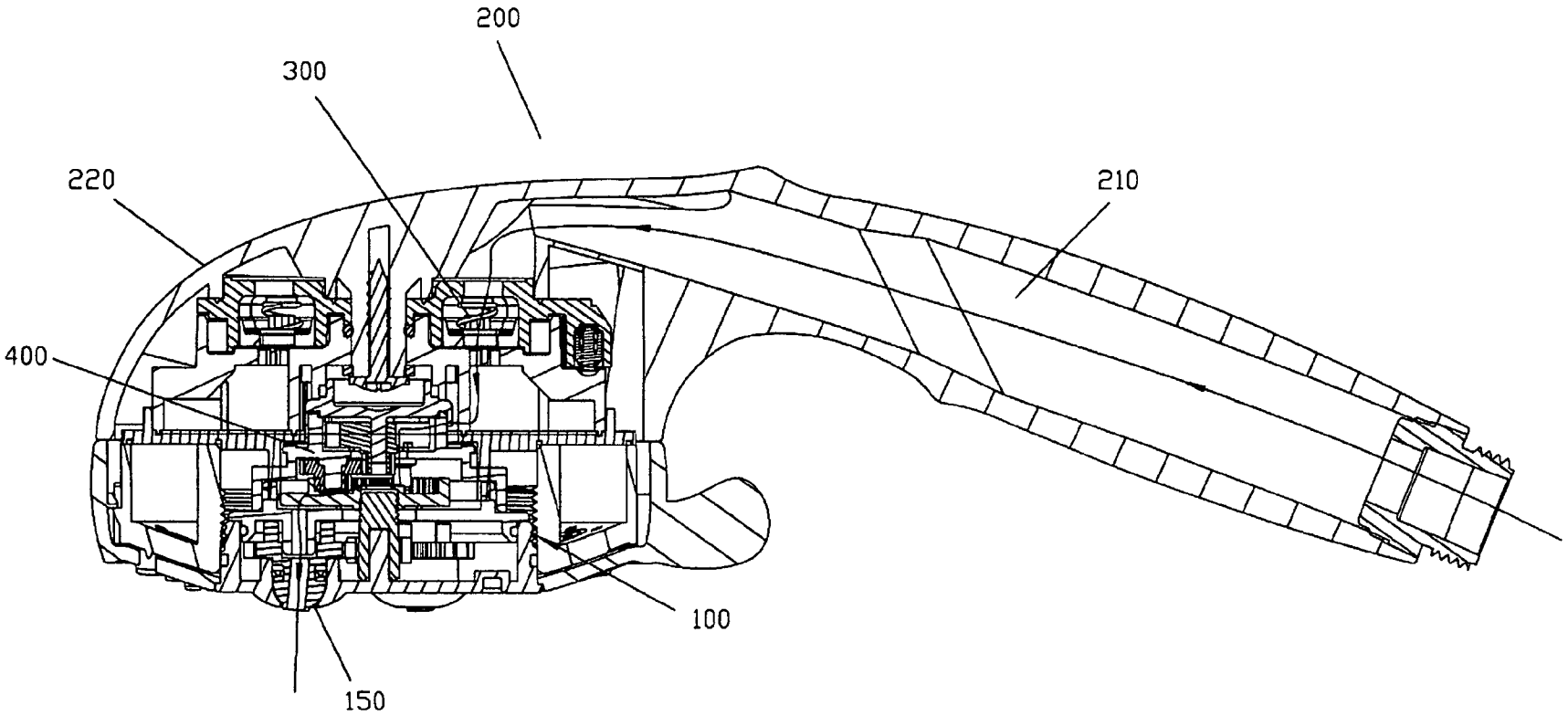
FIG. 13 illustrates a sectional diagram of a hand shower head of a fourth embodiment.

Referring to FIG. 13, it illustrates a shower head applied above mentioned outlet device, this embodiment differs from the second embodiment in that: it further comprises the retarding mechanism 400 mentioned in the third embodiment. The outlet device of the third embodiment is assembled in the shower head.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet device, comprising a base portion (100), the base portion (100) is disposed with at least an inlet (110) and a plurality of diversion holes (120), the base portion (100) is disposed with an impeller (130), the impeller (130) rotates when impacted by water flowing;

wherein a guard sheet (140) is movably disposed in the base portion (100), the impeller (130) is connected to the guard sheet (140) in driving way, so that the impeller (130) rotates to drive the guard sheet (140) to move, the guard sheet (140) moves with respect to the base portion (100) to control the diversion holes (120) to outflow water in cycles intermittently;

each diversion hole (120) is rotatably connected with an outlet nozzle (150), the impeller (130) is connected to the outlet nozzles (150) in driving way, so that the impeller (130) rotates to drive the outlet nozzles (150) to rotate;

the impeller (130) is connected with a driving gear (132) coaxially, each outlet nozzle (150) is fixedly connected with a driven gear (152) coaxially, the driven gears (152) are engaged to the driving gear (132), a retarding mechanism (400) is disposed between the impeller (130) and the driving gear (132), the retarding mechanism (400) comprises a change gear set (420), an internal gear (430) and a pinion gear (410).

2. The outlet device according to claim 1, wherein the guard sheet (140) is fixedly connected to the impeller (130).

3. The outlet device according to claim 1, wherein the diversion holes (120) are annularly arranged about the rotating axis of the impeller (130);

the outlet nozzles (150) are annularly arranged about the rotating axis of the impeller (130).

4. The outlet device according to claim 1, wherein the rotating axis of the outlet nozzle (150) is parallel to the rotating axis of the impeller (130).

5. The outlet device according to claim 1, wherein the outlet nozzle (150) has outlet (151), the outflow direction of the outlet (151) is intersected with the rotating axis of the outlet nozzle (150).

6. The outlet device according to claim 1, wherein the base portion (100) comprises a base (160), a cover (170) and a capping (180);

the base (160) is disposed with a plurality of assembly holes (161), the cover (170) covers on the base (160) in sealing way, the cover (170) is disposed with a plurality of diversion openings, the diversion openings are respectively connected to the assembly holes (161) to form above mentioned diversion holes (120), the outlet nozzles (150) are assembled in the assembly holes (161);

the capping (180) covers the cover (170) in sealing way and forming an upper chamber, the impeller (130) is disposed in the upper chamber, the guard sheet (140) is movably contacted on the cover (170), the impeller (130) has a power shaft, the power shaft runs through the cover (170) from top to bottom to connect to the outlet nozzle (150) in driving way.

7. The outlet device according to claim 6, wherein the periphery of the diversion opening of the cover (170) extends downwardly to form a conduit (171), the end face of the outlet nozzle (150) is concaved with a groove connected to the outlet (151), the conduit (171) is rotatably connected to the groove in fitting way.

8. The outlet device according to claim 6, wherein the end portion of the outlet nozzle (150) extends outwardly to form an annular portion, the annular portion is connected to the power shaft of the impeller (130) in driving way, the annular portion is supported on the base (160).

9. The outlet device according to claim 1, wherein the lower end of the impeller (130) is connected to the pinion gear (410), the large gear (421) of the change gear set (420) is engaged to the pinion gear (410), the small gear (422) of the change gear set (420) is engaged to the internal gear (430); the upper end of the driving gear (132) is connected to the internal gear (430) in driving way.

10. The outlet device according to claim 1, wherein the guard sheet (140) is fixedly connected to the outer side of the internal gear (430).

11. The outlet device according to claim 1, wherein the base portion (100) comprises a base (160), an upper cover (170A), a lower cover (1708) and a capping (180); the base (160) disposed with a plurality of assembly holes (161), the lower cover (170B) covers on the base (160) in sealing way, the lower cover (170B) disposed with a plurality of diversion openings, the diversion openings are respectively connected to the assembly holes (161) to form above mentioned diversion holes (120), the outlet nozzles (150) are assembled in the assembly holes (161); the capping (180) covers on the upper cover (170A) in sealing way and forming an upper chamber; the impeller (130) is disposed in the upper chamber; the upper cover (170A) and the lower cover (170B) are connected in sealing way and forming a central chamber, the retarding mechanism (400) is located in the central chamber; the guard sheet (140) is contacted on the lower cover (170B); the impeller (130) is connected to the guard sheet (140) by the retarding mechanism (400) in driving way and is at the same time connected to the outlet nozzles (150) in driving way.

12. A shower head having an outlet device according to claim 1, wherein the outlet device comprises a base portion (100), the base portion (100) is disposed with at least an inlet (110) and a plurality of diversion holes (120), the base portion (100) is disposed with an impeller (130), the impeller (130) rotates when impacted by water flowing;

wherein a guard sheet (140) is movably disposed in the base portion (100), the impeller (130) is connected to the guard sheet (140) in driving way, so that the impeller (130) rotates to drive the guard sheet (140) to move, the guard sheet (140) moves with respect to the base portion (100) to control the diversion holes (120) to outflow water in cycles intermittently;

each diversion hole (120) is rotatably connected with an outlet nozzle (150), the impeller (130) is connected to the outlet nozzles (150) in driving way, so that the impeller (130) rotates to drive the outlet nozzles (150) to rotate;

wherein the shower head comprises a main body (200) and a switch mechanism (300), the main body (200) is disposed with an inlet waterway (210) and at least two diversion waterways, the switch mechanism (300) is assembled to the main body (200) and is connected to the inlet waterway (210) and the at least two diversion waterways to control the at least two diversion waterways to connect to the inlet waterway (210) alternately;

the base portion (100) of the outlet device is assembled in the main body (200) and one diversion waterway is connected to the inlet (110), wherein the impeller (130) is connected with a driving gear (132) coaxially, each outlet nozzle (150) is fixedly connected with a driven gear (152) coaxially, the driven gears (152) are engaged to the driving gear (132);

the diversion holes (120) are angularly arranged about the rotating axis of the impeller (130);

the outlet nozzles (150) are angularly arranged about the rotating axis of the impeller (130), wherein a retarding mechanism (400) is disposed between the impeller (130) and the driving gear (132), the retarding mechanism (400) comprises a change gear set (420), an internal gear (430) and a pinion gear (410).

13. The shower head according to claim 12, wherein the lower end of the impeller (130) is connected to the pinion gear (410), the large gear (421) of the change gear set (420) is engaged to the pinion gear (410), the small gear (422) of the change gear set (420) is engaged to the internal gear (430);

the upper end of the driving gear (132) is connected to the internal gear (430) in driving way.

14. The shower head according to claim 12, wherein the guard sheet (140) is fixedly connected to the outer side of the internal gear (430).

15. The shower head according to claim 12, wherein the base portion (100) comprises a base (160), an upper cover (170A), a lower cover (170B) and a capping (180);

the base (160) is disposed with a plurality of assembly holes (161), the lower cover (170B) covers on the base (160) in sealing way, the lower cover (170B) is disposed with a plurality of diversion openings, the diversion openings are respectively connected to the assembly holes (161) to form above mentioned diversion holes (120), the outlet nozzles (150) are assembled in the assembly holes (161);

the capping (180) covers on the upper cover (170A) in sealing way and forming an upper chamber;

the impeller (130) is disposed in the upper chamber;

the upper cover (170A) and the lower cover (170B) are connected in sealing way and forming a central chamber, the retarding mechanism (400) is located in the central chamber;

the guard sheet (140) is contacted on the lower cover (170B);

the impeller (130) is connected to the guard sheet (140) by the retarding mechanism (400) in driving way and is at the same time connected to the outlet nozzles (150) in driving way.

* * * * *